US005720187A

United States Patent [19]

Matuo

[11] Patent Number: 5,720,187

[45] Date of Patent: Feb. 24, 1998

[54] KNITTING NEEDLE WITH A FLEXIBLE CORD

[75] Inventor: Yosimi Matuo, Osaka, Japan

[73] Assignee: Clover Manufacturing Co. Ltd., Osaka, Japan

[21] Appl. No.: 696,185

[22] Filed: Aug. 13, 1996

[30] Foreign Application Priority Data

Mar. 21, 1996 [JP] Japan ..... 8-064049

[51] Int. Cl.[6] ..... D04B 3/02

[52] U.S. Cl. ..... 66/117

[58] Field of Search ..... 66/117, 116

[56] References Cited

U.S. PATENT DOCUMENTS

| | | | |
|---|---|---|---|
| 1,313,461 | 8/1919 | Brown | 66/117 |
| 1,966,690 | 7/1934 | Van Bergen | 66/117 |
| 2,045,267 | 6/1936 | Graham | 66/117 |
| 2,093,631 | 9/1937 | Burnham | 66/117 |
| 2,094,262 | 9/1937 | Burnham | 66/117 |
| 2,230,495 | 2/1941 | Kohlmann | 66/117 |
| 2,462,473 | 2/1949 | Delaney | 66/117 |
| 2,507,174 | 5/1950 | Phillips | 66/117 |
| 4,553,410 | 11/1985 | Okada | 66/117 |
| 4,646,543 | 3/1987 | Okada | 66/117 |

FOREIGN PATENT DOCUMENTS

| | | | |
|---|---|---|---|
| 803783 | 4/1951 | Germany | 66/117 |
| 905661 | 5/1954 | Germany | 66/117 |
| 28 53 701 | 7/1980 | Germany . | |
| 87 08 212 | 9/1987 | Germany . | |
| 28006 | 2/1907 | United Kingdom | 66/117 |
| 407145 | 3/1934 | United Kingdom . | |
| 730866 | 6/1955 | United Kingdom . | |
| 763792 | 12/1956 | United Kingdom . | |
| 876144 | 8/1961 | United Kingdom . | |
| 1127180 | 9/1968 | United Kingdom . | |
| 2036812 | 7/1980 | United Kingdom . | |

*Primary Examiner*—John J. Calvert

*Attorney, Agent, or Firm*—Michael D. Bednarek; Kilpatrick Stockton LLP

[57] ABSTRACT

A circular knitting needle is provided which includes a flexible cord, a first needle portion connected to one end of the flexible cord, and a second needle portion connected to the other end of the flexible cord. The first and second needle portions are inclined in the same direction relative to the flexible cord which is stretched. The first needle portion may be inclined by a higher degree than the second needle portion. Further, the first needle portion may be made shorter than the second needle portion, and the flexible cord may be made to have a flattened cross section.

5 Claims, 10 Drawing Sheets

KNITTING NEEDLE WITH A FLEXIBLE CORD

BACKGROUND OF THE INVENTION

1. Field of the Invention

The present invention relates to a knitting needle with a flexible cord for performing a circular knitting operation.

2. Description of the Related Art

In knitting a clothing article such as a sweater, it is necessary to perform a circular knitting operation wherein a yarn is knit into a circular or cylindrical form. There are two ways of performing such a knitting operation.

A first way for performing a circular knitting operation is to use four separate knitting needles 20–23, as shown in FIG. 12 of the accompanying drawings. Specifically, the user's dominant or favored hand holds one of the four needles 20–23 to form new loops of a yarn onto another needle held by the user's less favored hand, whereas the other two needles are used to retain the previously formed yarn loops. The four needles 20–23 are arranged in a mutually intersecting relation to form an rectangular annulus while performing the knitting operation, and the formed yarn loops are shifted from one needle to another as the knitting operation proceeds. Thus, by shifting the user's hand from one needle to another, the yarn (yarn loops) is knit into a cylindrical form.

Obviously, due to the need for shifting the user's hands and the formed yarn loops from one needle to another, the use of the four knitting needles 20–23 is not only time-taking and requires a considerable skill. Thus, this way of performing a circular knitting operation is not suitable for an unskillful user.

A second way for performing a circular knitting operation is to use a knitting needle with a flexible cord, as shown in FIG. 13. Such a knitting needle is referred to as "circular knitting needle" and disclosed in U.S. Pat. Nos. 4,553,410 and 4,646,543 for example.

Specifically, the circular knitting needle designated by reference numeral 3 comprises two needle portions 31 connected together by a flexible cord 30. In a circular knitting operation, the needle portions 31 are brought toward each other into an intersecting relation, so that a circle is defined by the knitting needle 3. Thus, the use of the circular knitting needle 3 obviates the need for shifting the user's hands and the knit yarn loops from one needle to another.

However, if the length of the flexible cord 30 is too short, there is a difficulty in for bringing the two needle portions 31 toward each other into an intersecting relation because the short cord need be flexed to a high extent. For this reason, the length of the circular knitting needle is limited to about 40 cm at the smallest. Thus, the prior art circular knitting needle 3 is not suitable for knitting a cylindrical clothing article or portion of a small diameter.

SUMMARY OF THE INVENTION

It is, therefore, an object of the present invention to provide a circular knitting needle which can be conveniently used for knitting a cylindrical work having a relatively small diameter such as arm portions of a sweater, finger portions of a glove, or socks.

According to one aspect of the present invention, there is provided a knitting needle comprising a flexible cord, a first needle portion connected to one end of the flexible coard, and a second needle portion connected to the other end of the flexible cord, wherein the first and second needle portions are inclined in the same direction relative to the flexible cord which is stretched.

According to the arrangement described above, the first and second needle portions, which are inclined in the same direction relative to the stretched flexible cord, can be easily brought to their intersecting position without unduly flexing the cord. Thus, even if the flexible cord is relatively short, the circular knitting needle can be conveniently deformed into a circular form for performing a knitting operation.

Preferably, the first needle portion may be inclined relative to the flexible cord by a larger angle than the second needle portion. Further, the first needle portion may be advantageously rendered shorter than the second needle portion. During a knitting operation, the longer second needle portion is held by the dominant or favored hand of the user for skillful movement as required for forming loops of the knitting yarn, whereas the shorter first needle portion is held by the less favored hand of the user simply for receiving the formed loops of the knitting yarn.

According a preferred embodiment of the present invention, the flexible cord has a flattened cross section with a cross-sectionally shorter axis and a cross-sectionally longer axis, and the first and second needle portions are inclined relative to the flexible cord in a cross-sectionally shorter axis direction. Further, the first and second needle portions may be circular in cross section and have an equal diameter, whereas the flexible cord may have a width which is substantially equal to the diameter of the first and second needle portions.

The flexible cord which is flattened in cross section becomes more easily bendable in the cross-sectionally shorter axis direction than in the cross-sectionally longer axis direction. Thus, the first and second needle portions can be easily brought into their intersecting position by flexing the flexible cord in the cross-sectionally shorter axis direction. By contrast, since the flexible cord becomes reluctantly bendable in the cross-sectionally longer axis direction, it can be reliably prevented from sagging in this direction during the knitting operation.

In view of simplicity of production, the first and second needle portions may be formed integral with the flexible cord. However, the first and second needle portions may be prepared separately from the flexible cord and later connected thereto in a known manner.

According to another aspect of the present invention, there is provided a knitting needle comprising a flexible cord, a first needle portion connected to one end of the flexible coard, and a second needle portion connected to the other end of the flexible cord, wherein the first needle portion is shorter than the second needle portion.

According to a further aspect of the present invention, there is provided a knitting needle comprising a flexible cord, a first needle portion connected to one end of the flexible coard, and a second needle portion connected to the other end of the flexible cord, wherein the flexible cord has a flattened cross section with a cross-sectionally shorter axis and a cross-sectionally longer axis for flexing more easily in a cross-sectionally shorter axis direction.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
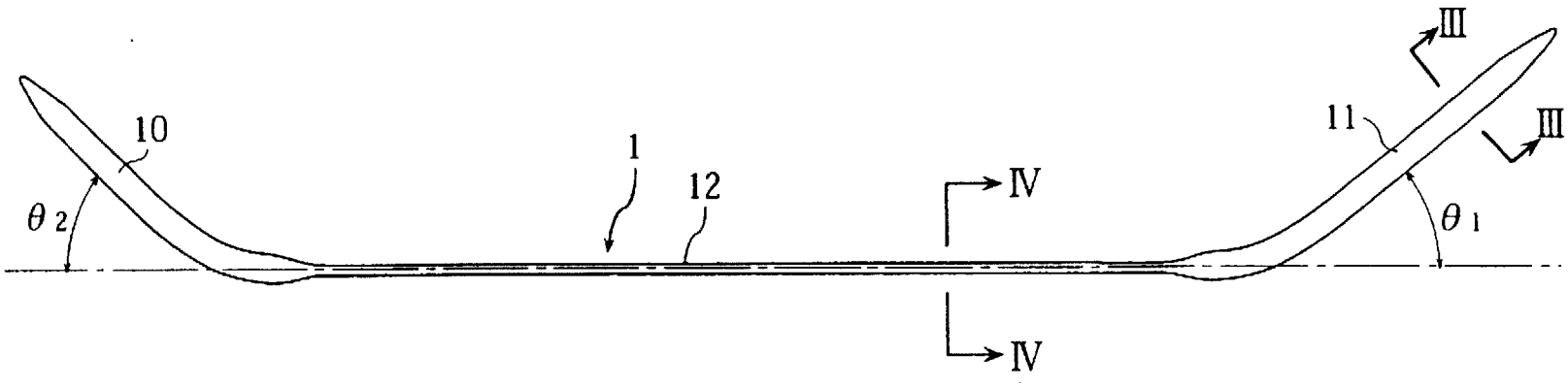
FIG. 1 is a side view showing a circular knitting needle according to the present invention.

Referring first to FIGS. 1 through 4 of the accompanying drawings, there is illustrated a circular knitting needle embodying the present invention. The circular knitting needle, generally designated by reference numeral 1, comprises a first needle portion 10 connected to one end of a flexible cord 12, and a second needle portion 11 connected to the other end of the flexible cord 12. In this embodiment, the two needle portions 10, 11 and the flexible cord 12 are integrally made of a plastic or resin material such as nylon. However, the flexible cord 12 alone may be made of a plastic material such as nylon, whereas the two needle portions 10, 11 may be separately made of a metal, wood or bamboo and connected to the flexible cord 12.

Figure 3:
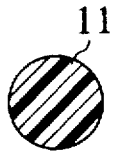
FIG. 3 is an enlarged sectional view taken along lines III—III in FIG. 1.

As illustrated in FIG. 3, the first and second needle portions 10, 11 are equally circular in cross section. However, the first and second needle portions 10, 11 are different in length. Specifically, the first needle portion 10 is shorter than the second needle portion 11. The first needle portion 10 is shorter because it only need be conveniently held by the less favored hand of the user but requires no skillful needle tip movement. The second needle portion 11 is longer because it is adapted to be held by the dominant or favored hand of the user for skillful needle tip movement.

Figure 2:
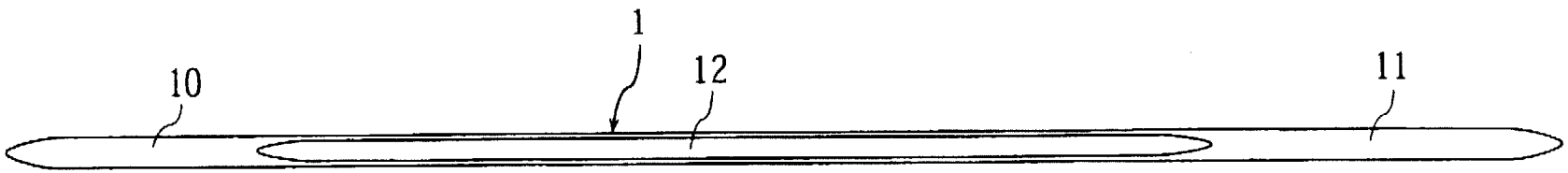
FIG. 2 is a plan view of the same needle.
Figure 4:
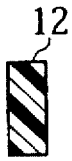
FIG. 4 is an enlarged sectional view taken along lines IV—IV in FIG. 1.

As shown in FIG. 4, the flexible cord 12 is flattened in cross section and has a width substantially equal to the diameter of each needle portion 10, 11 (see also FIG. 2). According to the present embodiment, the flexible cord 12 has a rectangular cross section. Thus, the flexible cord 12 is more flexible in the thickness direction of the cord than in the widthwise direction.

In this specification, the thickness direction of the flexible cord 12 which is perpendicular to the longitudinal direction of the cord is referred to as "cross-sectionally shorter axis direction", whereas the widthwise direction of the flexible cord 12 which is also perpendicular to the longitudinal direction of the cord is referred to as "cross-sectionally longer axis direction".

Assuming that the flexible cord 12 is stretched straight, the first needle portion 10 in its natural state is inclined by an angle $\theta_2$ relative to the cord in the cross-sectionally shorter axis direction thereof. Similarly, the second needle portion 11 in its natural state is inclined by an angle $\theta_1$ relative to the cord in the cross-sectionally shorter axis direction thereof. In the present embodiment, the angle $\theta_1$ is about 20° for example, whereas the angle $\theta_2$ is about 45° for example. This difference in inclination angle of the two needle portions 10, 11 reflects the fact that the second needle portion 11 is longer and therefore more easily bendable relative to the flexible cord 12 than the first needle portion 10.

According to the illustrated embodiment, each of the first and second needle portions 10, 11 is inclined by permanently bending it adjacent to a corresponding end of the flexible cord. If the needle portion is made of a plastic or resin material (like the flexible cord 12), such permanent bending may be performed under heating. On the other hand, if the needle portion is made of a metal material, the permanent bending may be performed by causing a plastic deformation of the needle portion.

Figure 5:
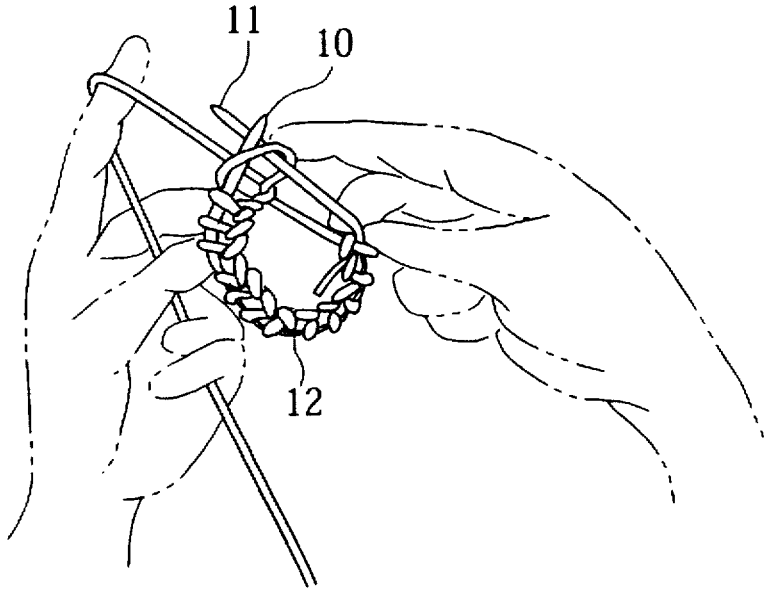
FIG. 5 is a schematic view showing the manner of using the same needle for knitting.
Figure 6:
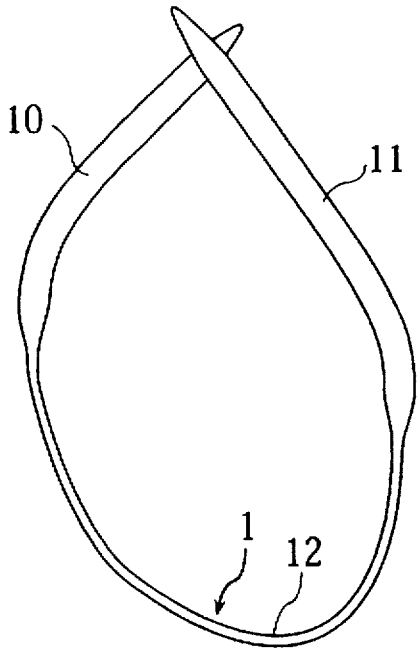
FIG. 6 is a side view showing the same needle bent into a circular form.
Figure 7A:
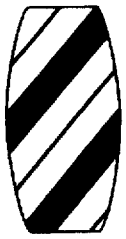
FIGS. 7*a* through 7*d* are sectional views similar to FIG. 3 but showing different cross-sectional configurations for each needle portion of the circular knitting needle.
Figure 7C:
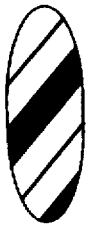
Figure 7B:
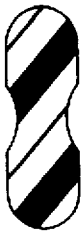
Figure 7D:
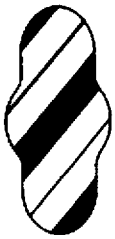
Figure 8:
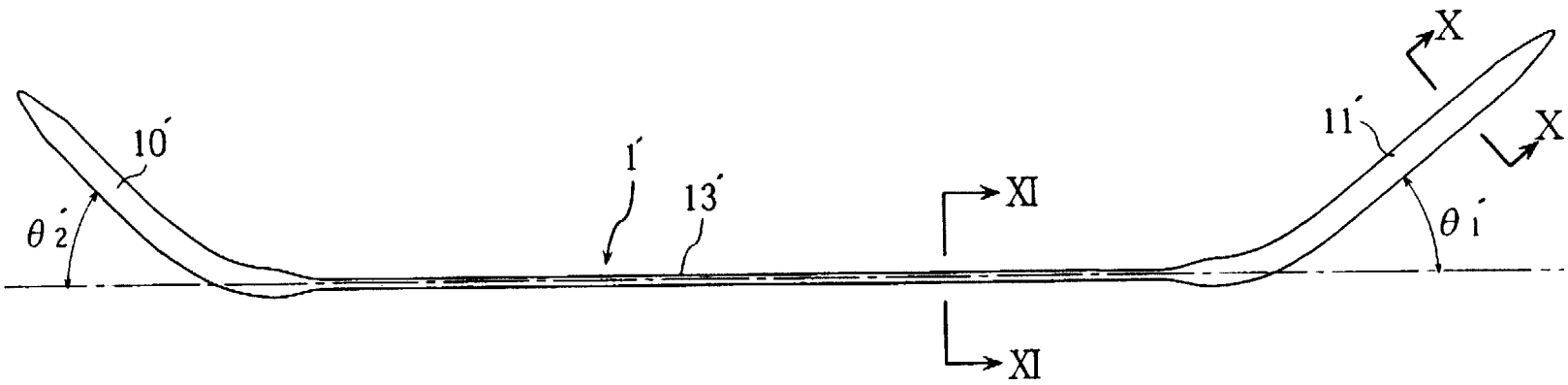
FIG. 8 is a side view showing another circular knitting needle according to the present invention.
Figure 9:
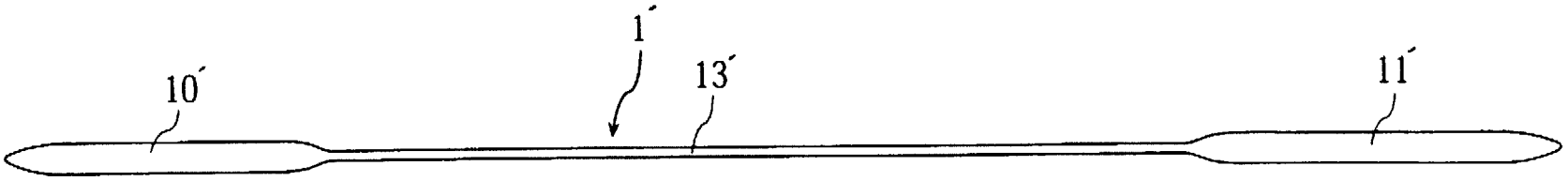
FIG. 9 is a plan view of the needle shown in FIG. 8.

In use of the circular knitting needle 1 described above, the first or shorter needle portion 10 is held by the less favored hand (left hand for example) of the user, whereas the second or longer needle portion 11 is held by the dominant hand (right hand for example), as shown in FIG. 5. In this condition, the first and second needle portions 10, 11 are brought toward each other into intersecting or loop-forming relation by flexing the flexible cord 12 in its cross-sectionally shorter axis direction, and a knitting operation is performed mainly by dexterously moving the second needle portion 11.

As previously described, the first and second needle portions 10, 11 are inclined relative to the flexible cord 12 (as stretched) in the cross-sectionally shorter axis direction thereof. Thus, the two needle portions 10, 11 can be readily brought to their intersecting position (FIG. 5) without unduly flexing or bending the cord 12.

During the knitting operation, the second or longer needle portion 11 is held by the dominant hand of the user for dexterous movement as required for conveniently forming loops of the knitting yarn. However, as long as the second needle portion 11 ensures a convenient loop-forming operation and is longer than the first needle portion 10, it may be made as short as possible to reduce the overall length of the circular knitting needle 1.

On the other hand, the first or shorter needle portion 10 is held by the less favored hand of the user because this needle portion need only be supported generally at a fixed position for receiving the yarn loops formed by the other needle portion 11. Thus, the reduced length of the first needle portion 10 contributes to a length reduction of the circular knitting needle 1 as a whole without providing any inconvenience for the knitting operation.

As previously described, the flexible cord 12 has a flattened cross section. Therefore, the cord is selectively bendable in the cross-sectionally shorter axis direction for conveniently bringing the two needle portions 10, 11 toward each other.

By contrast, the cord 12 provides a relatively high bending rigidity in the cross-sectionally longer axis direction, thereby preventing the cord 12 from unexpectedly sagging in the cross-sectionally longer axis direction under the weight of the knit work. This feature also facilitates the knitting operation.

According to the embodiment shown in FIGS. 1 through 6, the flexible cord 12 is rectangular in cross section. However, the flexible cord 12 may be otherwise flattened. Examples of the flattened cross section of the flexible cord are illustrated in FIGS. 7*a* through 7*d*.

FIGS. 8 through 11 show another circular knitting needle embodying the present invention. In this embodiment, the same reference numerals as used for the embodiment of FIGS. 1 through 6 are also used with a prime (') to indicate corresponding parts.

Figure 10:
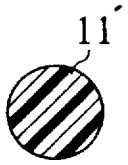
FIG. 10 is an enlarged sectional view taken along lines X—X in FIG. 8.
Figure 11:
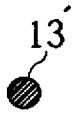
FIG. 11 is an enlarged sectional view taken along lines XI—XI in FIG. 8.
Figure 12:
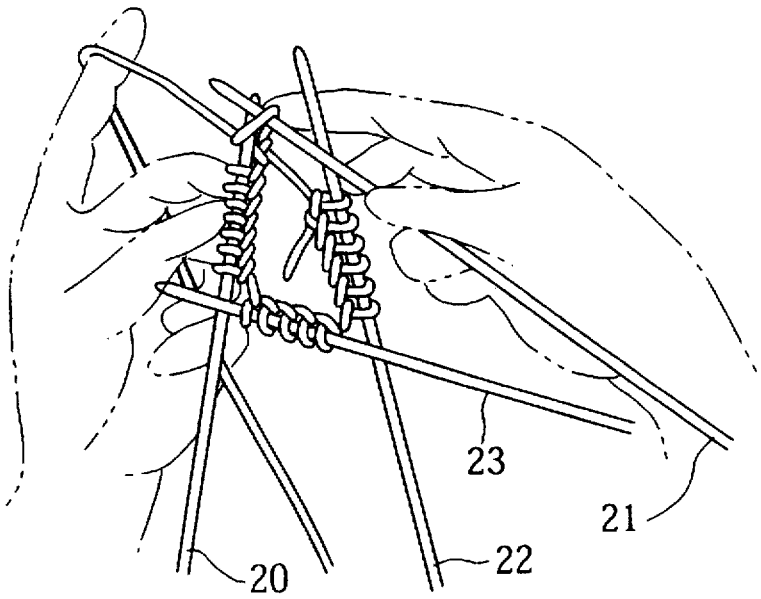
Fig. 12 Prior Art
FIG. 12 is a schematic view showing a knitting operation using prior art non-circular needles.
Figure 13:
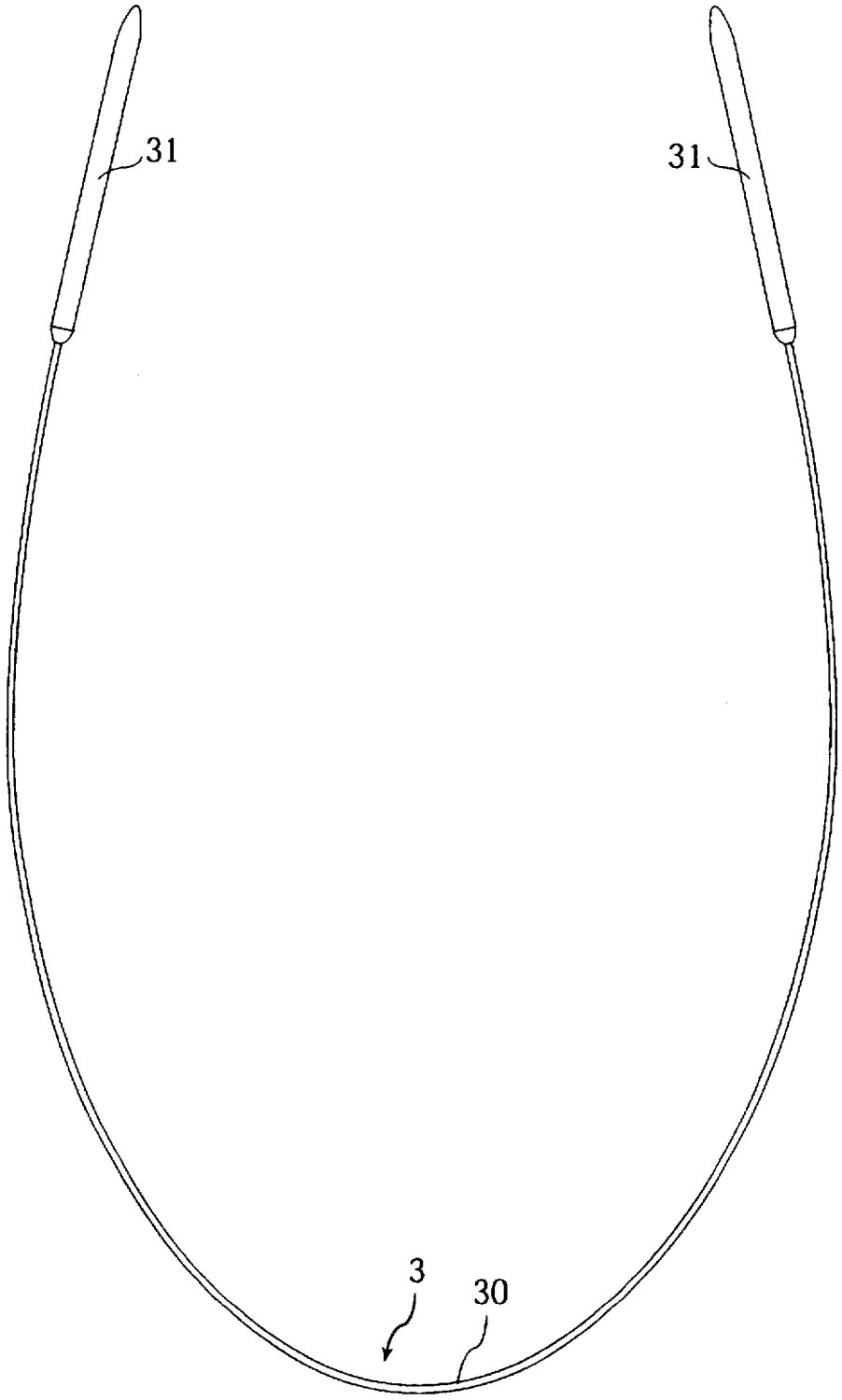
Fig. 13 Prior Art
FIG. 13 is a side view showing a prior art circular knitting needle.

According to the embodiment shown in FIGS. 8 through 11, again, the circular knitting needle 1' comprises a first needle portion 10' connected to one end of a flexible cord 12', and a second needle portion 11 connected to the other end of the flexible cord 12'. In this embodiment, the two needle portions 10', 11' are equally circular in cross section, as shown in FIG. 10. Further, the flexible cord 1' is also circular in cross section but has a smaller diameter than the two needle portions 10', 11', as shown in FIG. 11. Further, the first needle portion 10' is inclined by an angle $\theta_2$,(about 45° for example) relative to the cord in the cross-sectionally shorter axis direction thereof, whereas the second needle portion 11 is inclined by an angle $\theta_1$, (about a 40° for example) relative to the cord in the cross-sectionally shorter axis direction thereof.

As described above, the embodiment of FIGS. 8 through 11 differs from that of FIGS. 1 through 6 only in that the flexible cord 12' has a circular cross section. Thus, most of the advantages described for the embodiment of FIGS. 1 through 6 are also applicable to the embodiment of FIGS. 8 through . The present invention being thus described, it is obvious that the same may be varied in many ways. For instance, the first and second needle portions may be inclined by an equal angle. Further, in the case where the first and second needle portions are inclined relative to the flexible cord, these two needle portions may have an equal length. Moreover, in the case where the two needle portions have different length, these needle portions need not be inclined relative to the flexible cord. Still further, though the present invention is advantageously applicable where the overall length of the circular knitting needle is relatively small, it may be also applied to a circular knitting needle having a length of no less than 40 cm. Such variations are not to be regarded as a departure from the spirit and scope of the invention, and all such variations as would be obvious to those skilled in the art are intended to be included within the scope of the following claims.

I claim:

1. A knitting needle comprising:

a flexible cord;

a first needle portion connected to one end of the flexible cord; and a second needle portion connected to the other end of the flexible cord;

wherein the first and second needle portions are inclined in the same direction relative to the flexible cord which is stretched; and wherein each of the needles and the cord are formed of a singular piece of material.

2. The knitting needle according to claim 1, wherein the flexible cord has a flattened cross section with a cross-sectionally shorter axis and a cross-sectionally longer axis, the first and second needle portions being inclined relative to the flexible cord in a cross-sectionally shorter axis direction.

3. The knitting needle according to claim 2, wherein the first and second needle portions are circular in cross section and have an equal diameter, the flexible cord having a width which is substantially equal to the diameter of the first and second needle portions.

4. The knitting needle according to claim 1, wherein the first and second needle portions are integral with the flexible cord.

5. A knitting needle comprising:

a flexible cord having two ends;

first shorter needle portion having a predetermined length connected to one end of the flexible cord; and second longer needle portion having a predetermined length which is longer than the length of the shorter needle portion connected to the other end of the flexible cord;

herein the first and second needle portions are inclined in the same direction relative to the flexible cord which is stretched;

herein the first shorter needle portion is inclined by a larger angle than the second longer needle portion; and herein each of the needles and the cord are formed of a singular piece of material.

* * * * *